US006819038B2

(12) United States Patent
Song et al.

(10) Patent No.: US 6,819,038 B2
(45) Date of Patent: Nov. 16, 2004

(54) DOUBLE DYNAMIC FOCUS ELECTRON GUN

(75) Inventors: Yong-Seok Song, Ulsan Metropolitan (KR); Sung-Jun An, Suwon (KR); Do-Hyoung Kim, Ulsan Metropolitan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 10/216,876

(22) Filed: Aug. 13, 2002

(65) Prior Publication Data

US 2003/0057819 A1 Mar. 27, 2003

(30) Foreign Application Priority Data

Sep. 24, 2001 (KR) ..... 2001/59035

(51) Int. Cl.[7] ..... H01J 29/50

(52) U.S. Cl. ..... 313/409; 313/412; 313/414; 315/382; 315/368.15

(58) Field of Search ..... 313/409, 412, 313/413, 415, 414, 428, 432; 315/382, 382.1, 368.15

(56) References Cited

U.S. PATENT DOCUMENTS 5,386,178 A * 1/1995 Son et al. ..... 315/15
5,488,265 A * 1/1996 Chen ..... 313/414
5,739,629 A * 4/1998 Yun et al. ..... 313/412
5,754,014 A * 5/1998 Kim et al. ..... 315/382.1
6,456,018 B1 * 9/2002 Bae et al. ..... 315/382
6,498,427 B1 * 12/2002 Song et al. ..... 313/414
6,545,403 B1 * 4/2003 Lee ..... 313/414

* cited by examiner

*Primary Examiner*—Joseph Williams
*Assistant Examiner*—Kevin Quarterman
(74) *Attorney, Agent, or Firm*—Robert E. Bushnell, Esq.

(57) ABSTRACT

An electron gun for a cathode ray tube includes at least one auxiliary quadruple lens forming unit adapted to control an electron beam diverging in the vertical direction and focused in the horizontal direction by a plurality of focus electrodes, at least one first quadruple lens forming unit adapted to control the electron beam passing through the auxiliary quadruple lens focused in the vertical direction and diverging in the horizontal direction, and at least one second quadruple forming unit adapted to control the electron beam passing through the first quadruple lens diverging in the vertical direction and focused in the horizontal direction, installed between the screen electrode of a triode portion and a final acceleration electrode of the cathode ray tube and sequentially arranged in a direction from a screen electrode to a screen of the cathode ray tube.

13 Claims, 9 Drawing Sheets

DOUBLE DYNAMIC FOCUS ELECTRON GUN

CLAIM OF PRIORITY

This application makes reference to, incorporates the same herein, and claims all benefits accruing under 35 U.S.C. §119 from my application DOUBLE DYNAMIC FOCUS ELECTRON GUN filed with the Korean Industrial Property Office on Sep. 24, 2001 and there duly assigned Ser. No. 59035/2001.

BACKGROUND OF THE INVENTION

1. Technical Field

The present invention relates to a double dynamic focus electron gun for a cathode ray tube (CRT), and more particularly, to a double dynamic focus electron gun for a cathode ray tube in which a positive astigmatism correction is performed.

2. Related Art

In general, an electron gun for a color cathode ray tube installed at a neck portion of the cathode ray tube emits thermions. The performance thereof depends on the state of landing of an electron beam generated by the thermions onto a fluorescent film.

The electron gun is classified into a static focus electron gun and a dynamic focus electron gun. The dynamic focus electron gun reduces the occurrence of a phenomenon in which the shape of an electron beam emitted from an electron gun and landing on a fluorescent film becomes oval by being affected by a difference between a barrel magnetic field and a pincushion magnetic field as the electron beam is deflected by a deflection yoke. The dynamic focus electron gun makes the shape of the electron beam emitted from the electron gun relatively oval in synchronism with horizontal and vertical deflection periods. Recently, the dynamic focus electron gun is widely used.

U.S. Pat. No. 5,404,071, entitled DYNAMIC FOCUSING ELECTRON GUN, issued to Son on 4 Apr. 1995, relates to a dynamic focusing electron gun having more than two quadrupole lenses. In the case of arranging focusing lenses in increasing even numbers as in the technology of U.S. Pat. No. 5,404,071, the following problem occurs: as the current increases, the spherical aberration effect increases so that the horizontal resolution is deteriorated at the periphery of a screen.

As described above, the development of a dynamic focus electron gun concentrates on how much the resolution at the periphery of a screen can be improved. To reduce spherical aberration of the main lens in an electron gun disclosed in Japanese Patent Publication No. 3-95835, a main lens is formed asymmetrically and a focusing force in the horizontal direction is less than that of the vertical direction. However, when a large amount of current used, the effect of reducing the spherical aberration of the main lens is not sufficient.

Also, U.S. Pat. No. 5,744,917, entitled ELECTRON GUN ASSEMBLY FOR A COLOR CATHODE RAY TUBE APPARATUS, issued to Kawaharada on 28 Apr. 1998, relates to an electron gun with two quadruple lenses and a sub-lens. The gun of U.S. Pat. No. 5,744,917 needs additional installation of a separate electrode member which makes its manufacture complicated. Also a moiré effect at the periphery of the screen is not sufficiently prevented.

While the foregoing efforts provide advantages, we note that they fail to adequately provide a efficient, effective, and convenient double dynamic focus electron gun.

SUMMARY OF THE INVENTION

To solve the above-described problems, it is an object of the present invention to provide an electron gun for a cathode ray tube (CRT) in which a focus characteristic of an electron beam is improved so that a resolution at the periphery of a screen is improved.

To solve the above-described problems, it is a further object of the present invention to provide an electron gun for a cathode ray tube (CRT) in which a focus characteristic of an electron beam is uniform throughout the screen.

To solve the above-described problems, it is another object of the present invention to provide an electron gun for a cathode ray tube (CRT) in which a a horizontal resolution at the periphery of a screen is improved.

To achieve the above objects and others, there is provided an electron gun for a color cathode ray tube comprising a triode portion including a cathode emitting three electron beams and a control electrode and a screen electrode for controlling the electron beams and forming a cross-over point, an electron lens forming portion including first, second, third, fourth, and fifth focus electrodes and a final acceleration electrode, sequentially installed in a direction from the screen electrode to a fluorescent film of the cathode ray tube, for forming a plurality of electron lenses, and applying a voltage to form at least one auxiliary quadruple lens between the second and third focus electrodes, at least one first quadruple lens between the third and fourth focus electrodes, at least one second quadruple lens between the fourth and fifth focus electrodes, and at least one main lens between the fifth focus electrode and the final acceleration electrodes, by applying a screen voltage to the screen electrode and the second focus electrode, a static focus voltage to the first and fourth focus electrodes, a parabola type dynamic focus voltage synchronized with a deflection signal to the third and fifth focus electrodes, and an anode voltage to the final acceleration electrode.

It is preferred in the present invention that electron beam passing holes formed at the input side surface of the third focus electrode are vertically elongated in a direction in which the three electron beam passing holes are arranged, and that electron beam passing holes formed at the input side surface of the third focus electrode are formed by installing an electrode member having vertically elongated electron beam passing holes at the input side surface of the third focus electrode.

It is preferred in the present invention that the electron beams are vertically focused and horizontally diverged by the first quadruple lens, and vertically diverged and horizontally focused by the second quadruple lens, and that the electron beams are vertically diverged and horizontally focused by the auxiliary quadruple lens as the electron beams are deflected toward the periphery of a screen.

To achieve the above objects and others, there is provided an electron gun for a color cathode ray tube comprising a triode portion including a cathode emitting three electron beams and a control electrode and a screen electrode for controlling the electron beams and forming a cross-over point, an electron lens forming portion including first, second, third, fourth, and fifth focus electrodes and a final acceleration electrode, sequentially installed in a direction from the screen electrode to a fluorescent film of the cathode ray tube, for forming a plurality of electron lenses, and applying a voltage to form at least one auxiliary quadruple lens between the first and second focus electrodes, at least one first quadruple lens between the third and fourth focus electrodes, at least one second quadruple lens between the fourth and fifth focus electrodes, and at least one main lens between the fifth focus electrode and the final acceleration electrodes, by applying a screen voltage to the screen electrode, a static focus voltage to the first and fourth focus electrodes, a parabola type dynamic focus voltage synchronized with a deflection signal to second, third, and fifth focus electrodes, and an anode voltage to the final acceleration electrode.

It is preferred in the present invention that electron beam passing holes formed at the output side surface of the first focus electrode are horizontally elongated in a direction in which the three electron beam passing holes are arranged, and electron beam passing holes formed at the input side surface of the second focus electrode are vertically elongated in the direction in which the three electron beam passing holes are arranged.

It is preferred in the present invention that electron beam passing holes formed at the output side surface of the first focus electrode are formed by installing an electrode member having electron beam passing holes which are horizontally elongated in a direction in which the three electron beam passing holes are arranged, at the output side surface of the first focus electrode, and electron beam passing holes formed at the input side surface of the second focus electrode are formed by installing an electrode member having electron beam passing holes which are vertically elongated in the direction in which the three electron beam passing holes are arranged, at the input side surface of the second focus electrode.

It is preferred in the present invention that electron beam passing holes formed at the output side surface of the first focus electrode are vertically elongated in a direction in which the three electron beam passing holes are arranged, and electron beam passing holes formed at the input side surface of the second focus electrode have a circular shape or the shape of a keyhole having a circular central portion formed in a slot which is vertically elongated in a direction in which the three electron beam passing holes are arranged.

It is preferred in the present invention that electron beam passing holes formed at the output side surface of the first focus electrode are formed by installing an electrode member having electron beam passing holes which are vertically elongated in a direction in which the three electron beam passing holes are arranged, at the output side surface of the first focus electrode, and electron beam passing holes formed at the input side surface of the second focus electrode are formed by installing an electrode member having circular electron beam passing holes or electron beam passing holes having the shape of a keyhole having a circular central portion formed in a slot which is vertically elongated in a direction in which the three electron beam passing holes are arranged, at the input side surface of the second focus electrode.

It is preferred in the present invention that the electron beams are vertically focused and horizontally diverged by the first quadruple lens, and vertically diverged and horizontally focused by the second quadruple lens, and that the electron beams are vertically diverged and horizontally focused by the auxiliary quadruple lens as the electron beams are deflected toward the periphery of a screen.

To achieve these and other objects in accordance with the principles of the present invention, as embodied and broadly described, the present invention provides an electron gun for a cathode ray tube, the electron gun comprising: a triode portion including at least one cathode emitting electron beams in a first direction toward a screen of a cathode ray tube, and including a control electrode and a screen electrode controlling the electron beams; a plurality of electrodes including first, second, third, fourth, and fifth focus electrodes and a final acceleration electrode sequentially installed in the first direction from the screen electrode to the screen, the plurality of electrodes forming a plurality of electron lenses; and applying a voltage to form at least one auxiliary quadruple lens between the second and third focus electrodes, forming at least one first quadruple lens between the third and fourth focus electrodes, forming at least one second quadruple lens between the fourth and fifth focus electrodes, and forming at least one main lens between the fifth focus electrode and the final acceleration electrode; the power supply performing the forming of the lenses by applying a screen voltage to the screen electrode and the second focus electrode, applying a static focus voltage to the first and fourth focus electrodes, applying a parabola type dynamic focus voltage synchronized with a deflection signal to the third and fifth focus electrodes, and applying an anode voltage to the final acceleration electrode.

To achieve these and other objects in accordance with the principles of the present invention, as embodied and broadly described, the present invention provides an electron gun for a cathode ray tube, the electron gun comprising: a triode portion including at least one cathode emitting electron beams in a first direction toward a screen of a cathode ray tube, and including a control electrode and a screen electrode controlling the electron beams; a plurality of electrodes including first, second, third, fourth, and fifth focus electrodes and a final acceleration electrode sequentially installed in the first direction from the screen electrode to the screen, the plurality of electrodes forming a plurality of electron lenses; and applying a voltage to form at least one auxiliary quadruple lens between the first and second focus electrodes, forming at least one first quadruple lens between the third and fourth focus electrodes, forming at least one second quadruple lens between the fourth and fifth focus electrodes, and forming at least one main lens between the fifth focus electrode and the final acceleration electrode; the power supply performing the forming of the lenses by applying a screen voltage to the screen electrode, applying a static focus voltage to the first and fourth focus electrodes, applying a parabola type dynamic focus voltage synchronized with a deflection signal to the second, third, and fifth focus electrodes, and applying an anode voltage to the final acceleration electrode.

To achieve these and other objects in accordance with the principles of the present invention, as embodied and broadly described, the present invention provides an electron gun for a cathode ray tube, the electron gun comprising: a triode portion including three cathodes emitting electron beams toward a screen of a cathode ray tube, and including a control electrode and a screen electrode controlling the electron beams, the three cathodes extending in a horizontal row; a plurality of electrodes including first, second, third, fourth, and fifth focus electrodes and a final acceleration electrode sequentially installed from the screen electrode to the screen, the plurality of electrodes forming a plurality of electron lenses; and applying a voltage to form at least one auxiliary quadruple lens between the second and third focus electrodes, forming at least one first quadruple lens between the third and fourth focus electrodes, forming at least one second quadruple lens between the fourth and fifth focus electrodes, and forming at least one main lens between the fifth focus electrode and the final acceleration electrode; the power supply performing the forming of the lenses by applying voltages to a selected subgroup of the electrodes, the selected subgroup being selected from among a first subgroup with the power supply applying a screen voltage to the screen electrode and the second focus electrode and applying a static focus voltage to the first and fourth focus electrodes and applying a parabola type dynamic focus voltage synchronized with a deflection signal to the third and fifth focus electrodes and applying an anode voltage to the final acceleration electrode, and a second subgroup with the power supply applying the screen voltage to the screen electrode, applying the static focus voltage to the first and fourth focus electrodes, applying the parabola type dynamic focus voltage synchronized with the deflection signal to the second, third, and fifth focus electrodes, and applying the anode voltage to the final acceleration electrode.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

Figure 1:
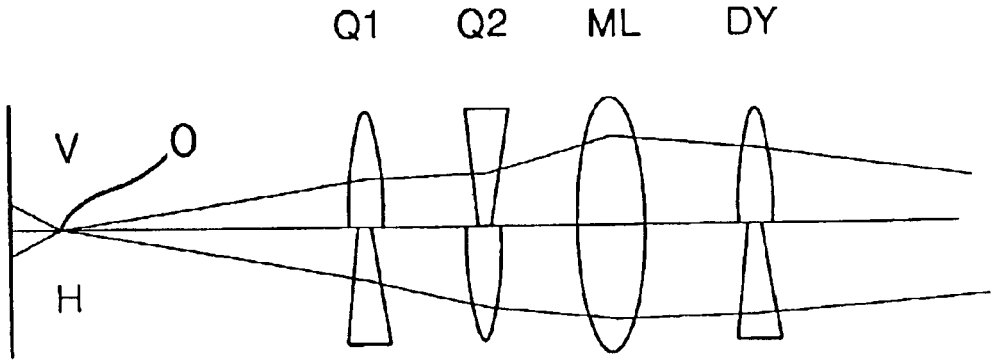
FIG. 1 is a view showing quadruple lenses of a double dynamic focus electron gun for a cathode ray tube (CRT)

While the present invention will be described more fully hereinafter with reference to the accompanying drawings, in which exemplary embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, different features of different embodiments disclosed can be combined.

To prevent the horizontal line distortion phenomenon from being a significant problem at the peripheral portion of a screen as the size of the screen of a cathode ray tube increases, a double dynamic focus electron gun for a cathode ray tube having quadruple lenses formed at two places therein is proposed.

In the dynamic focus type electron gun for a cathode ray tube, a control electrode, a screen electrode, a plurality of focus electrodes, and a final acceleration electrode are sequentially arranged from a cathode assembly where three cathodes are assembled. In general, the control electrode and the screen electrode have a shape of a plate and the other electrodes have a box shape. In each of the electrodes, three electron beam passing holes through which three electron beams emitted from the three cathodes pass are arranged in a direction along which the three cathodes are arranged.

In the electron gun having the above structure, predetermined voltages are applied to the respective electrodes. A screen voltage, a static focus voltage higher than the screen voltage, and a parabola type dynamic focus voltage synchronized with a deflection signal are applied through a variety of wiring methods, and an anode voltage is applied to the final acceleration electrode. The anode voltage is normally about 28 through 35 kilovolts (kV). The static focus voltage is about 28% of the anode voltage. The dynamic focus voltage is a value periodically repeating a range of 28±3% of the anode voltage.

Together with the voltages applied to the electrodes, by appropriately mixing the shapes of the electron beam passing holes at the input and output sides of the respective electrodes, electron lenses are formed by electric force of lines and equipotential lines generated between each of the electrodes as predetermined voltages are applied to the electrodes.

FIG. 1 is a view showing quadruple lenses of a double dynamic focus electron gun for a cathode ray tube (CRT). FIG. 1 shows a focusing state of quadruple lenses formed by the dynamic voltage among the electron lenses. Referring to the drawing, as the dynamic voltage increases according to deflection, a focusing lens and a diverging lens are formed vertically and horizontally, respectively, in a first quadruple lens Q1. In a second quadruple lens Q2, a diverging lens and a focusing lens are formed vertically and horizontally, respectively. The FIG. 1 shows a cross-over point O.

Actually, in a double dynamic focus electron gun, a pre-focusing lens and an auxiliary electron lens are formed in addition to the quadruple lenses. In FIG. 1, ML denotes a main lens. A resolution can be further improved at the periphery of a screen due to the double quadruple lenses. That is, a light beam is focused vertically by the first quadruple lens Q1 so that the light beam is less affected by spherical aberration at the main lens ML to magnify the diameter of the light beam in the vertical direction. Accordingly, a horizontally elongated light beam is rather increased in the vertical direction to prevent the moiré effect.

However, in the above double dynamic focus electron gun, a light beam is further divergent by the first quadruple lens Q1 in the horizontal direction and the diameter of the light beam is magnified in the main lens ML. Accordingly, not only is the light beam greatly affected by spherical aberration, but also the diameter of the light beam at the periphery of the screen is further magnified by a pin magnetic field in the horizontal direction by a deflection yoke DY. Also, as the current increases, the spherical aberration effect increases so that the horizontal resolution is deteriorated at the periphery of the screen.

Figure 2:
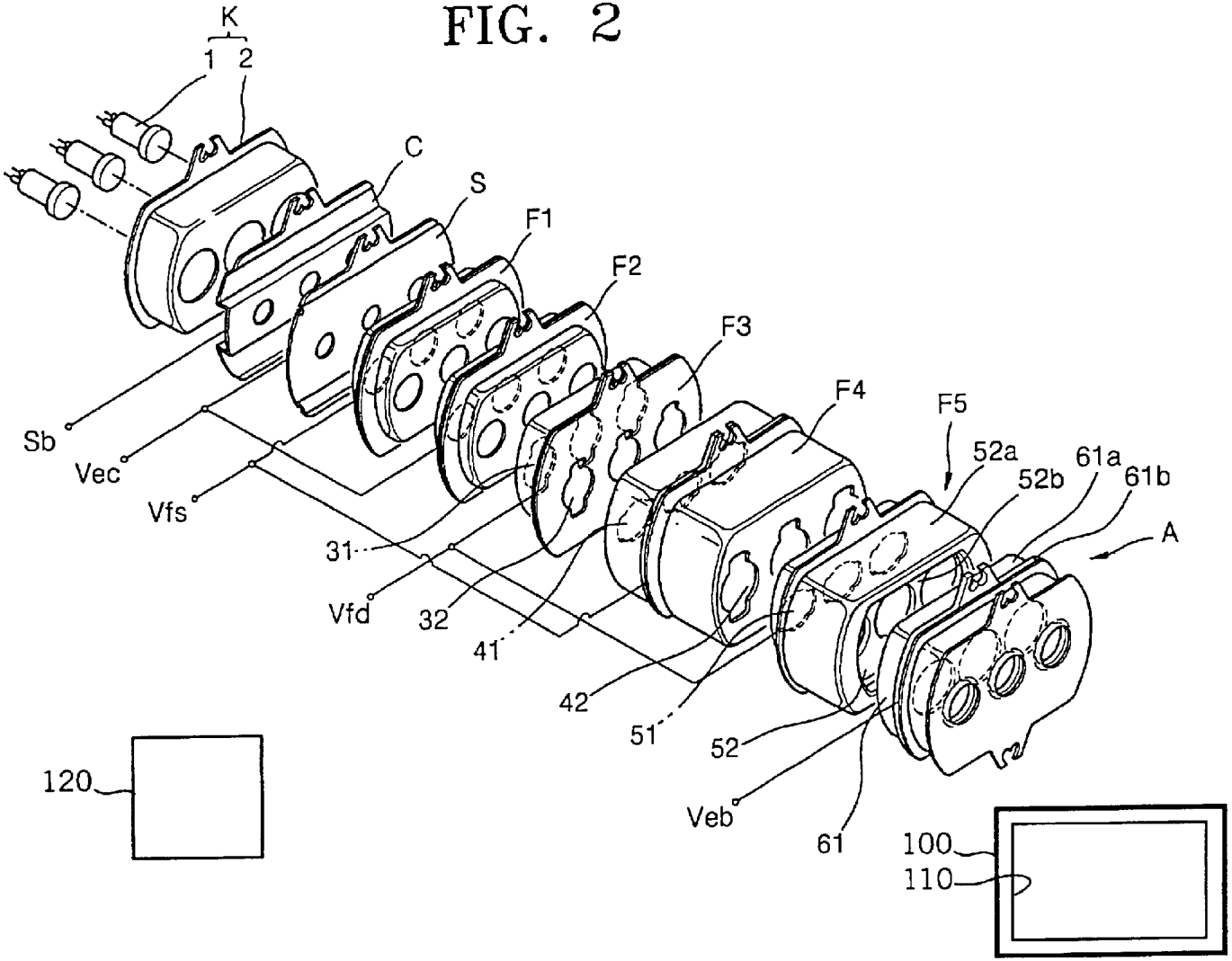
FIG. 2 is an exploded perspective view showing the structure of electrodes of a exemplary embodiment of an electron gun, in accordance with the principles of the present invention.

FIG. 2 is an exploded perspective view showing the structure of electrodes of an exemplary embodiment of an electron gun, in accordance with the principles of the present invention. FIG. 2 shows an electron gun for a color cathode ray tube (CRT) according to a exemplary embodiment of the present invention. The electron gun according to a exemplary embodiment of the present invention has a unipotential wiring structure.

As shown in the drawing, the electron gun of the exemplary embodiment of the present invention constituting a triode portion includes three cathodes 1 arranged in-line, a control electrode C and a screen electrode S. A blanking signal Sb is applied to the control electrode C. Also, first through fifth focus electrodes F1, F2, F3, F4, and F5 and a final acceleration electrode A are sequentially arranged to form an electron lens forming portion. The three cathodes 1 emit electron beams toward the fluorescent film 110 of a screen 100 of the cathode ray tube. The electron lens forming portion can also be referred to as a plurality of electrodes.

Each of the electrodes of the electron gun has three independent electron beam passing holes for forming an electron lens or a large diametric electron beam passing hole through which three electron beams pass. Vertically elongated electron beam passing holes 32 are formed at the output side surface of the third focus electrode F3.

Horizontally elongated electron beam passing holes 41 are formed at the input side surface of the fourth focus electrode F4. Vertically elongated electron beam passing holes 42 are formed at the output side surface of the fourth focus electrode F4. Horizontally elongated electron beam passing holes 51 are formed at the input side surface of the fifth focus electrode F5. Circular electron beam passing holes can be formed in each of the first and second focus electrodes F1 and F2, but are not limited thereto.

Also, the electron beam passing holes 31 at the input side surface of the third focus electrode F3 which had been previously formed circular are formed vertically elongated.

Each of the electron beam passing holes 31 at the input side surface of the third focus electrode F3 can have an indented portion indented to a predetermined depth formed at the upper and lower portions of a circular electron beam passing hole, having a keyhole shape, but are not limited thereto. For example, the electron beam passing holes 31 can be formed to be rectangular or oval.

Figure 3:
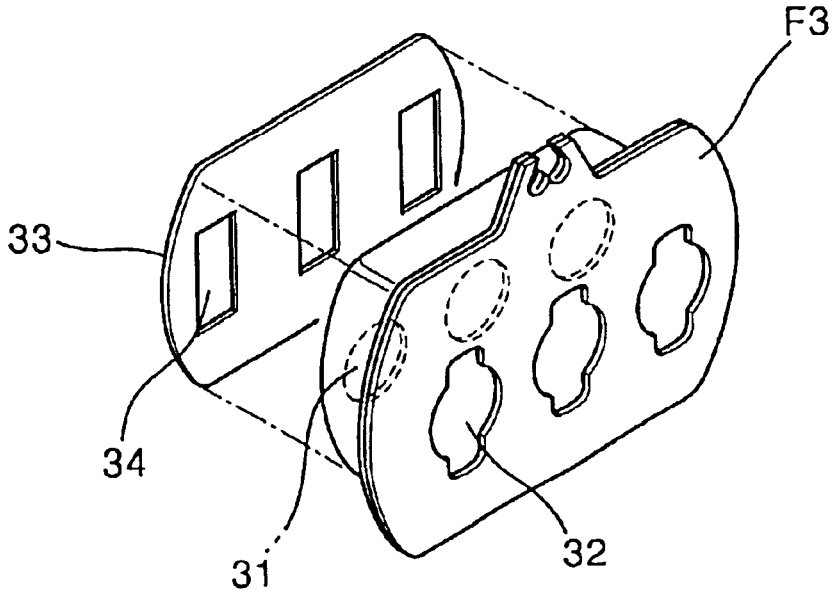
FIG. 3 is an exploded perspective view showing an another exemplary embodiment of the third focus electrode of FIG. 2, in accordance with the principles of the present invention.

FIG. 3 is an exploded perspective view showing an another exemplary embodiment of the third focus electrode of FIG. 2, in accordance with the principles of the present invention. FIG. 3 shows another exemplary embodiment of the third focus electrode F3. Circular electron beam passing holes 31 are formed at the input side surface of the third focus electrode F3. An electrode member 33 in which vertically elongated electron beam passing holes 34 are formed is attached to the input side surface of the third focus electrode F3.

Referring back to FIG. 2, the electron beam passing holes 52 at the output side surface of the fifth focus electrode F5 and the electron beam passing holes 61 at the input side surface of the final acceleration electrode A, forming a main lens, are respectively formed by outer electrode members 52*a* and 61*a* where large diametric electron beam passing holes are formed and inner electrode members 52*b* and 61*b* installed inside the outer electrode members 52*a* and 61*a* where three independent electron beam passing holes are formed.

A predetermined voltage is applied by a voltage applying portion 120 to each of the electrodes having the above structures. The voltage applying portion 120 can also be described as a power supply 120. The power supply 120 is shown in FIG. 2. The power supply provides the voltage to the electron gun of the present invention. As illustrated in FIG. 2, the terminals Vec, Vfs, Vfd, and Veb receive voltage from the power supply 120, for example.

First, a screen voltage Vec, that is a predetermined constant voltage, is applied to the screen electrode S and a second focus electrode F2. A static focus voltage Vfs higher than the screen voltage Vec is applied to the first and fourth focus electrodes F1 and F4. A parabola type dynamic focus voltage Vfd synchronized with a deflection signal is applied to the third and fifth focus electrodes F3 and F5. A high anode voltage Veb is applied to the final acceleration electrode A. Here, the anode voltage Veb is a high voltage of 28 kilovolts (kV) through 35 kV, the static focus voltage Vfs is about 28% of the anode voltage Veb, the dynamic focus voltage Vfd is within a range of 28±3% of the anode voltage Veb using the static focus voltage Vfs as a base voltage.

As the dynamic focus voltage Vfd is applied by the voltage applying portion, an auxiliary quadruple lens is formed in front of the third focus electrode F3 where the vertically elongated electron beam passing holes are formed at the input side surface thereof, that is, between the second focus electrode F2 and the third focus electrode F3.

A first quadruple lens is formed between the third focus electrode F3 and the fourth focus electrode F4. A second quadruple lens is formed between the fourth focus electrode F4 and the fifth focus electrode F5.

In the present exemplary embodiment of the present invention, a means for forming at least one auxiliary quadruple lens is the second focus electrode F2 to which the screen voltage is applied and the third focus electrode F3 to which the dynamic focus voltage is applied and where the vertically elongated electron beam passing holes 31 are formed at the input side surface thereof. A means for forming at least one first quadruple lens is the third focus electrode F3 to which the dynamic focus voltage is applied and the fourth focus electrode F4 to which the static focus voltage is applied. Also, a means for forming at least one second quadruple lens is the fourth focus electrode F4 to which the static focus voltage is applied and the fifth focus electrode F5 to which the dynamic focus voltage is applied.

Figure 4:
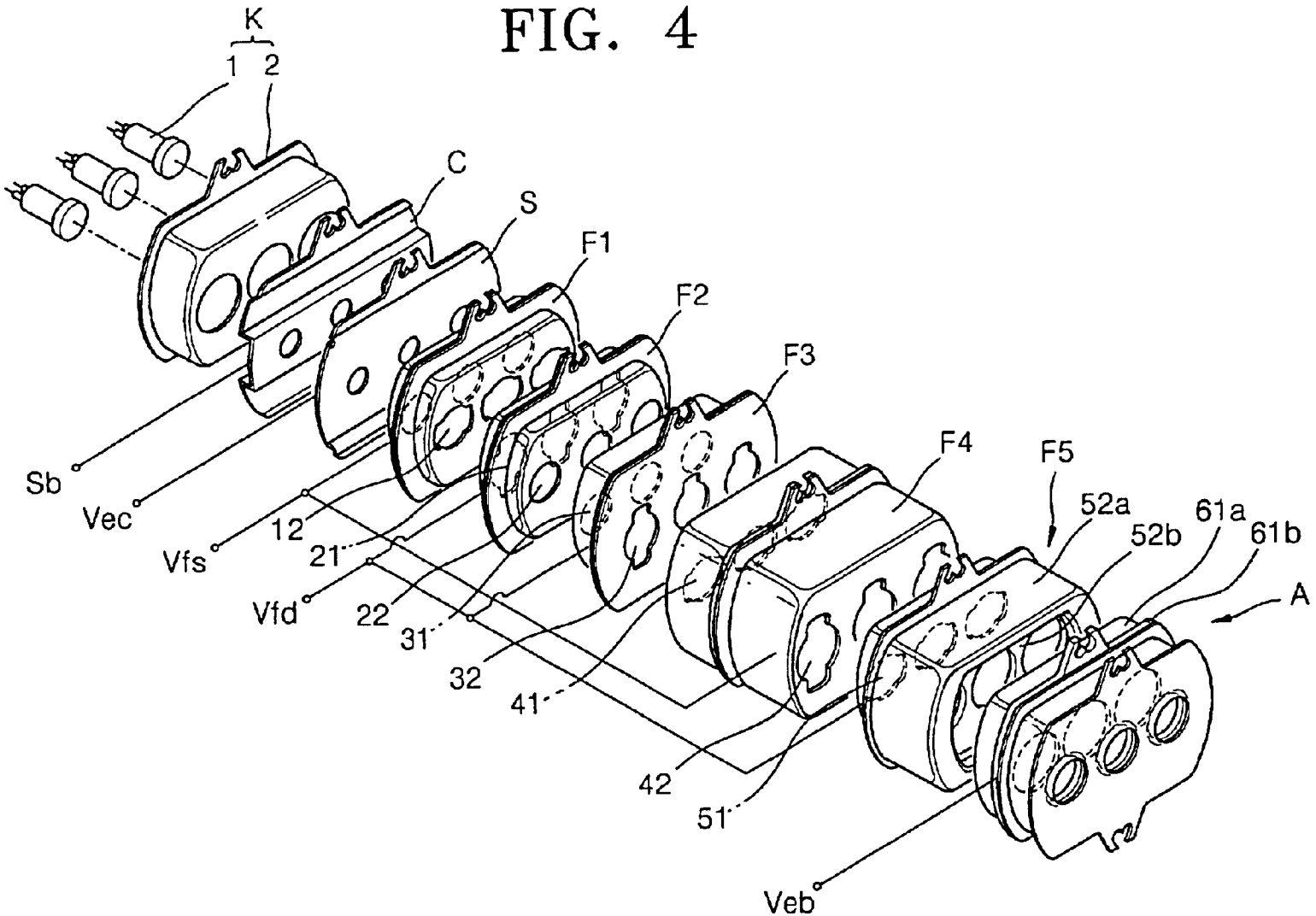
FIG. 4 is an exploded perspective view showing the structure of electrodes of another exemplary embodiment of an electron gun, in accordance with the principles of the present invention.

FIG. 4 is an exploded perspective view showing the structure of electrodes of another exemplary embodiment of an electron gun, in accordance with the principles of the present invention. FIG. 4 is a view for explaining the structure of an electron gun for a color cathode ray tube according to another exemplary embodiment of the present invention. The electron gun of this exemplary embodiment has a high bi-potential wiring structure.

The electron gun according to another exemplary embodiment of present invention includes the cathode 1, the control electrode C, and the screen electrode S, forming a triode portion, as described above. The first through fifth focus electrodes F1, F2, F3, F4, and F5 and the final acceleration electrode A, forming an electron lens forming portion, are sequentially arranged in a direction from the screen electrode S to a fluorescent film (not shown) of the electron gun.

Also, three independent electron beam passing holes for forming electron lenses or large diametric electron beam passing holes through which three electron beams pass are formed in each of the electrodes. Horizontally elongated electron beam passing holes 12 are formed at the output side surface of the first focus electrode F1 and vertically elongated electron beam passing holes 21 are formed at the input side surface of the second focus electrode F2. An auxiliary quadruple lens is formed between the first and second focus electrodes F1 and F2 which is described later. Also, the vertically elongated electron beam passing holes 32 are formed at the output side surface of the third focus electrode F3. The horizontally elongated electron beam passing holes 41 are formed at the input side surface of the fourth focus electrode F4. The vertically elongated electron beam passing holes 42 are formed at the output side surface of the fourth focus electrode F4. The horizontally elongated electron beam passing holes 51 are formed at the input side surface of the fifth focus electrode F5.

Figure 5A:
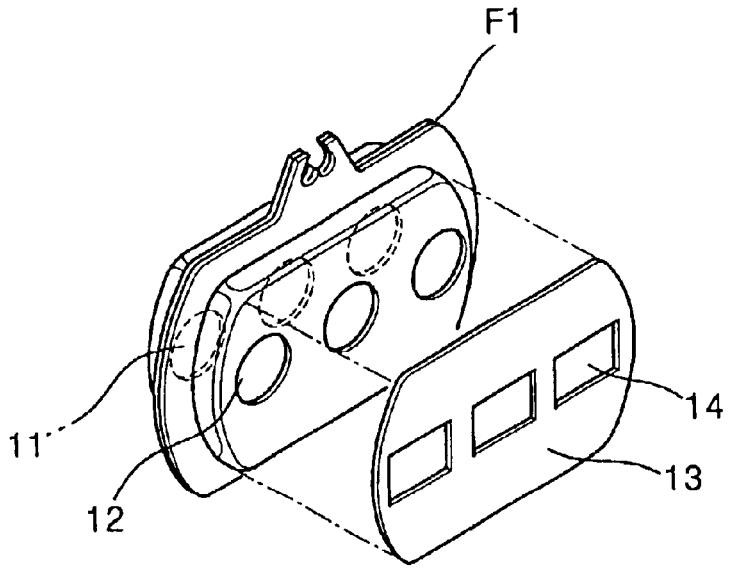
FIG. 5A is an exploded perspective view showing another exemplary embodiment of the first focus electrode of FIG. 4, in accordance with the principles of the present invention.
Figure 5B:
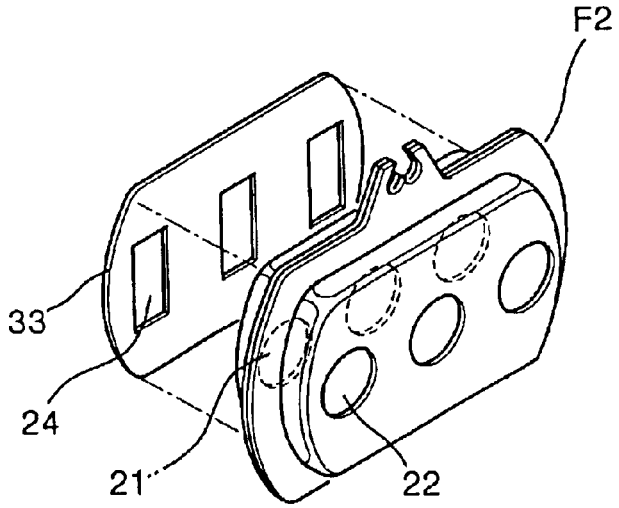
FIG. 5B is an exploded perspective view showing another exemplary embodiment of the second focus electrode of FIG. 4, in accordance with the principles of the present invention.

FIG. 5A is an exploded perspective view showing another exemplary embodiment of the first focus electrode of FIG. 4, in accordance with the principles of the present invention. FIG. 5B is an exploded perspective view showing another exemplary embodiment of the second focus electrode of FIG. 4, in accordance with the principles of the present invention.

Another exemplary embodiment of the first and second focus electrodes F1 and F2 having the above structures are shown in FIGS. 5A and 5B, respectively. That is, the first focus electrode F1 can be formed by attaching an electrode member 13 having horizontally elongated electron beam passing holes 12 to the output side surface of the first focus electrode F1 having circular electrode beam passing holes 12 formed at the output side surface thereof, as shown in FIG. 5A. The second focus electrode F2 can be formed by attaching an electrode member 23 having vertically elongated electron beam passing holes 24 to the input side surface of the second focus electrode F2 having circular electrode beam passing holes 21 formed at the input side surface thereof, as shown in FIG. 5B.

Figure 6:
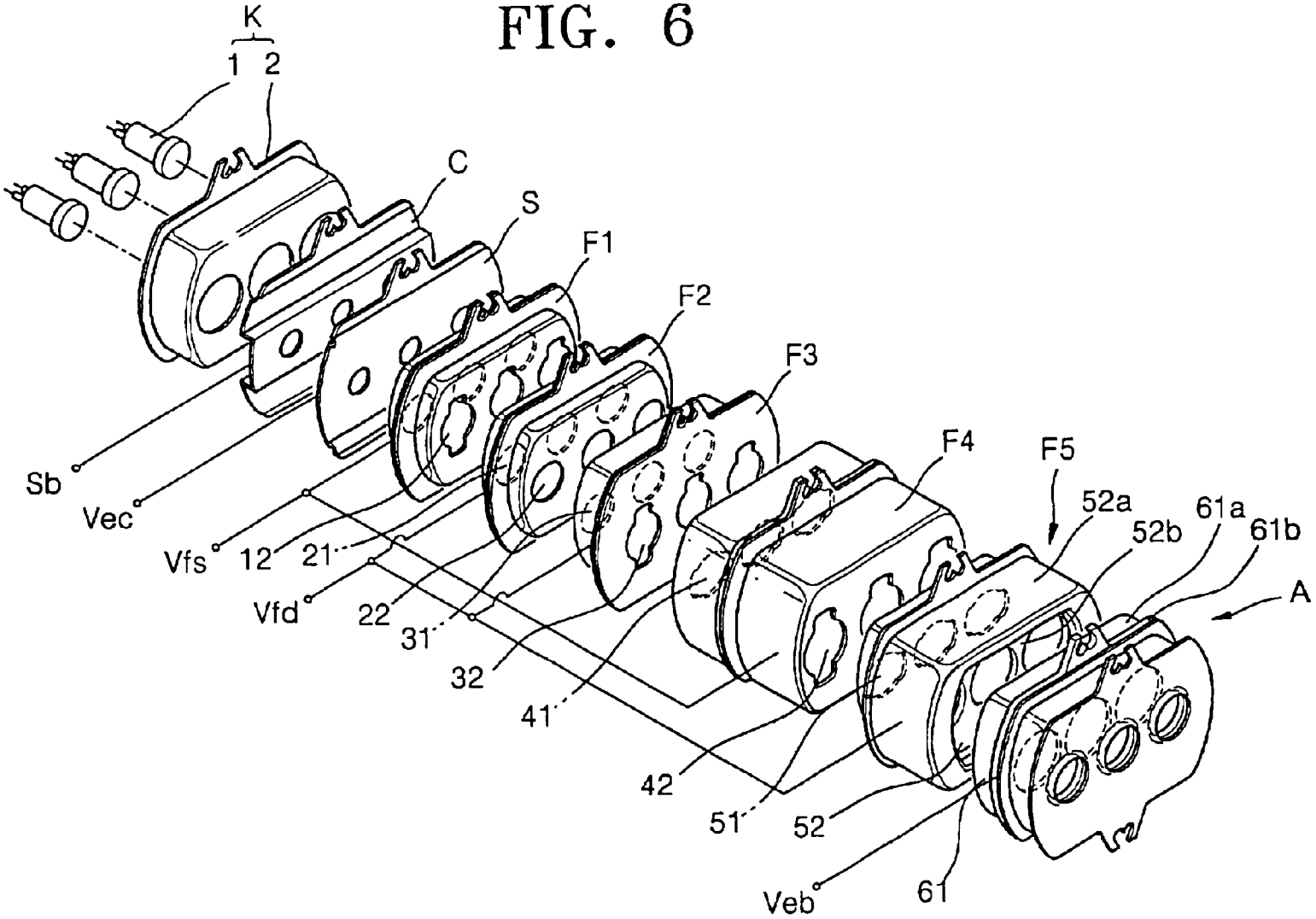
FIG. 6 is an exploded perspective view showing the structure of electrodes of yet another exemplary embodiment of an electron gun, in accordance with the principles of the present invention.
Figure 7:
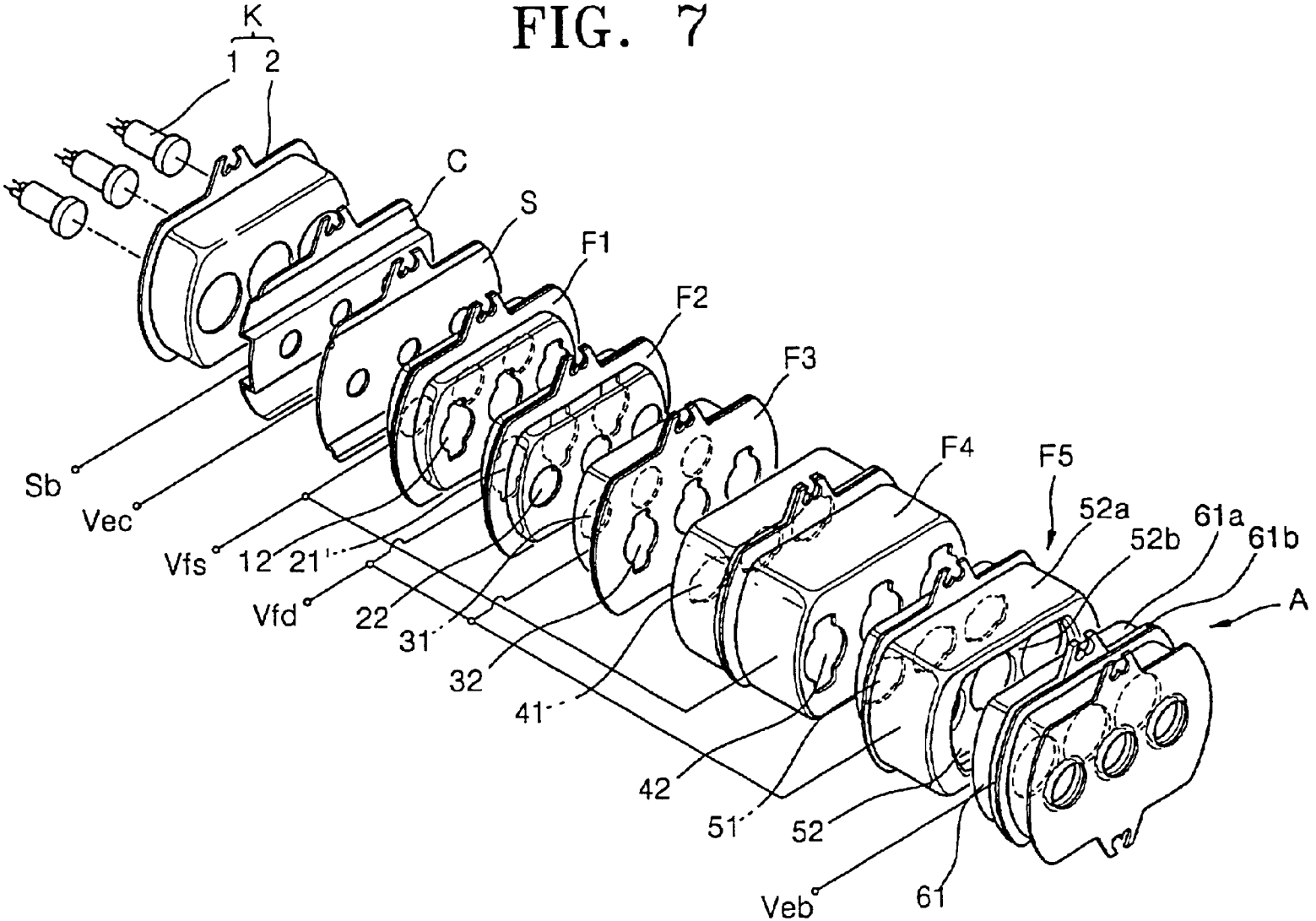
FIG. 7 is an exploded perspective view showing the structure of electrodes of a different exemplary embodiment of an electron gun, in accordance with the principles of the present invention.

FIG. 6 is an exploded perspective view showing the structure of electrodes of yet another exemplary embodiment of an electron gun, in accordance with the principles of the present invention. FIG. 7 is an exploded perspective view showing the structure of electrodes of a different exemplary embodiment of an electron gun, in accordance with the principles of the present invention.

FIG. 6 shows an electron gun for a color cathode ray tube according to yet another exemplary embodiment of the present invention. As shown in the drawing, in the electron gun according to the exemplary embodiment shown in FIG. 4, the electron beam passing holes 12 formed at the output side surface of the first focus electrode F1 are vertically elongated and the electron beam passing holes 21 formed at the input side surface of the second focus electrode F2 are circular, so that an auxiliary quadruple lens is formed therebetween. Circular electron beam passing holes 21 having upper and lower indented portions are formed at the input side surface of the second focus electrode F2 as shown in FIG. 7.

Figure 8A:
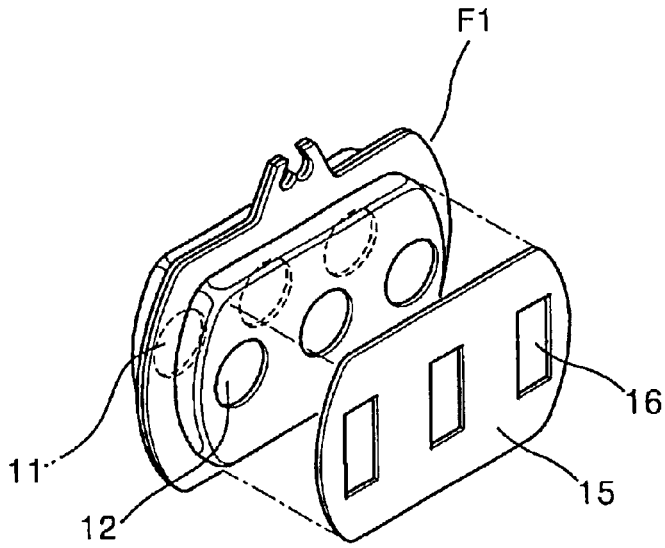
FIG. 8A is an exploded perspective view showing another exemplary embodiment of the first focus electrode of FIG. 6 and FIG. 7, in accordance with the principles of the present invention.
Figure 8B:
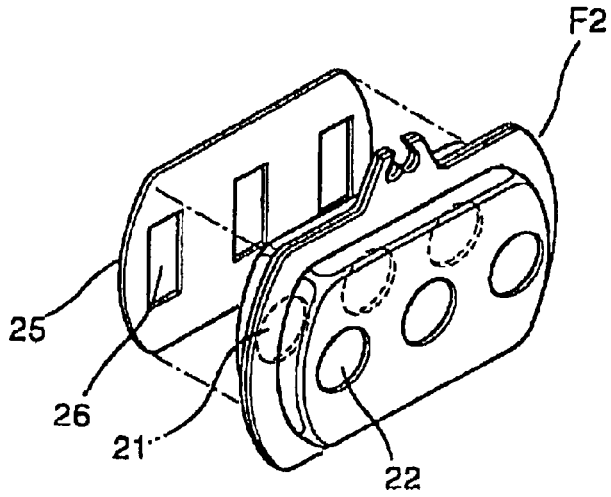
FIG. 8B is an exploded perspective view showing another exemplary embodiment of the second focus electrode of FIG. 7, in accordance with the principles of the present invention.

FIG. 8A is an exploded perspective view showing another exemplary embodiment of the first focus electrode of FIG. 6 and FIG. 7, in accordance with the principles of the present invention. FIG. 8B is an exploded perspective view showing another exemplary embodiment of the second focus electrode of FIG. 7, in accordance with the principles of the present invention.

The first focus electrode F1, as shown in FIG. 8A, can be formed by attaching an electrode member 15 having vertically elongated electron beam passing holes 16 to the output side surface of the first focus electrode F1 having the circular electron beam passing holes 12 at the output side surface thereof. In the exemplary embodiment shown in FIG. 7, the second focus electrode F2, as shown in FIG. 8B, can be formed by attaching an electrode member 25 having vertically elongated electron beam passing holes 26 to the input side surface of the second focus electrode F2 having the circular electron beam passing holes 21 at the input side surface thereof.

Since the shapes of the electron beam passing holes of the other electrodes are the same as those in the exemplary embodiment of FIG. 2, detailed descriptions thereof will be omitted.

A predetermined voltage is applied to the respective electrodes having the above structures through the voltage applying portion. Referring to FIGS. 4, 6, and 7, the screen voltage Vec is applied to the screen electrode 5, the static focus voltage Vfs higher than the screen voltage Vec is applied to the first and fourth focus electrodes F1 and F4, and the parabola type dynamic focus voltage Vfd synchronized with a deflection signal is applied to the second, third, and fifth focus electrodes F2, F3, and F5. An anode voltage Veb that is a high voltage is applied to the final acceleration electrode A. The respective voltages are the same as those of the exemplary embodiment described with reference to FIG. 2.

As the voltages are applied, the auxiliary quadruple lens is formed between the first focus electrode F1 and the second focus electrode F2. The first and second quadruple lenses are firmed between the third focus electrode F3 and the fourth focus electrode F4, and the fourth focus electrode F4 and the fifth focus electrode F5, respectively.

Thus, in the exemplary embodiments shown in FIGS. 4, 6, and 7, a means for forming at least one auxiliary quadruple lens is the first focus electrode F1 to which the static focus voltage is applied and the second focus electrode F2 to which the dynamic focus voltage is applied. A means for forming at least one first quadruple lens is the third focus electrode F3 to which the dynamic focus voltage is applied and the fourth focus electrode F4 to which the static focus voltage is applied. A means for forming at least one second quadruple lens is the fourth focus electrode F4 to which the static focus voltage is applied and the fifth focus electrode F5 to which the dynamic focus voltage.

The operation of the dynamic focus electron gun for a color cathode ray tube according to the present invention having the above structure is described as follows.

First, as predetermined electric potentials are applied to the electrodes forming the electron gun for a color cathode ray tube, electron lenses are formed by electric force of lines and equipotential lines between the respective electrodes. When the electron beam is scanned onto the central portion of the fluorescent film, the dynamic focus voltage Vfd using the static focus voltage Vfs as a base voltage is not applied so that the electron beam safely land on the central portion of the fluorescent film.

However, when the electron beam emitted from the electron gun is scanned onto the periphery of the fluorescent film, the dynamic focus voltage synchronized with a deflection signal is applied. In the case of having the uni bi-potential wiring structure as shown in FIG. 2, the auxiliary quadruple lens is formed between the second focus electrode F2 and the third focus electrode F3. In the case of having the high bi-potential wiring structure as shown in FIGS. 4, 6, and 7, the auxiliary quadruple lens is formed between the first focus electrode F1 and the second focus electrode F2.

In these exemplary embodiments, the first quadruple lens is formed between the third and fourth electrode F3 and F4. In these exemplary embodiments, the second quadruple lens is formed between the fourth and fifth focus electrodes F4 and F5.

Figure 9:
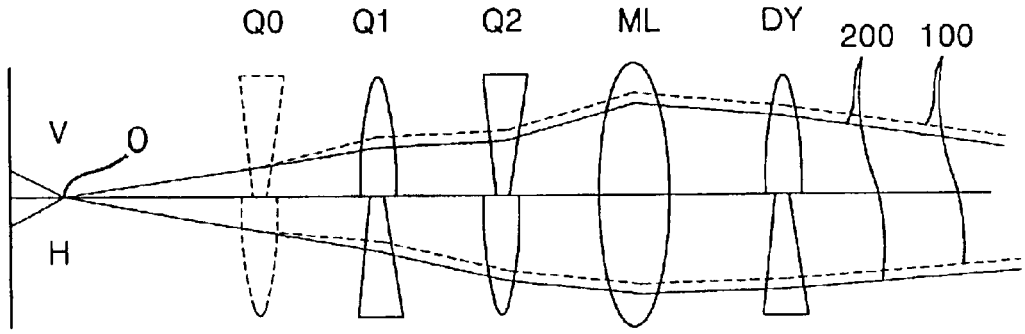
FIG. 9 is a view showing the electron lenses formed according to the principles of the present invention, and the operation of the electron lenses.

FIG. 9 is a view showing the electron lenses formed according to the principles of the present invention, and the operation of the electron lenses. FIG. 9 shows the operation of each of the quadruple lenses in the electron gun according to an embodiment of the present invention where the auxiliary quadruple lens is formed in front of the first quadruple lens toward a cathode.

As shown in the drawing, according to the present invention, an auxiliary quadruple lens Q0 and first and second quadruple lenses Q1 and Q2 are sequentially formed in a direction in which the electron beam is radiated. As the dynamic focus voltage Vfd is applied to the fifth focus electrode F5, the main lens ML having a relatively low magnification is formed between the fifth focus electrode F5 and the final acceleration electrode A.

In the FIG. 9, the electron beam 200 represents the beam of the electron gun shown in FIG. 1. Thus, the electron beam 200 represents the beam without the use of the auxiliary quadruple lens Q0. FIG. 9 shows a cross-over point O.

In the FIG. 9, the electron beam 100 represents the beam of the electron gun in accordance with the principles of the present invention. Thus, the electron beam 100 represents the beam with the use of the auxiliary quadruple lens Q0. Each of the different embodiments of the present invention include an auxiliary quadruple lens. See the different embodiments of the present invention shown in FIGS. 2, 4, 6, and 7, for example.

In the FIG. 9, a beam 100 and a beam 200 are compared with each other. The electron beam 100 is emitted by cathodes of an electron gun in which the auxiliary quadruple lens Q0 of the present invention is added to the two quadruple lenses Q1 and Q2, in accordance with the principles of the present invention. The electron beam 200 is emitted by cathodes of an electron gun having the two quadruple lenses Q1 and Q2, but not having the auxiliary quadruple lens Q0, as shown in FIG. 1.

The electron beam 100 of the electron gun according to the present invention is preliminarily focused and accelerated as it passes through the pre-focusing lens and the auxiliary lens, and then passes through the auxiliary quadruple lens Q0. In the auxiliary quadruple lens Q0, a diverging lens is formed vertically and a focusing lens is formed horizontally. Thus, the electron beam 100 passing through the auxiliary quadruple lens Q0 receives a diverging force in the vertical direction and a focusing force in the horizontal direction.

The divergent and focused electron beam 100 passes through the first quadruple lens Q1 formed by the third and fourth focus electrodes. In the first quadruple lens Q1, a focusing lens is formed vertically and a diverging lens is formed horizontally. Thus, the electron beam 100 passing through the first quadruple lens Q1 receives a focusing force in the vertical direction and a diverging force in the horizontal direction.

Also, the electron beam 100 passing through the second quadruple lens Q2, as shown in FIG. 9, receives a diverging force in the vertical direction and a focusing force in the horizontal direction. In the second quadruple lens Q2, a diverging lens is formed vertically and a focusing lens is formed horizontally.

Thus, the electron beam 100 is focused as it passes through the auxiliary quadruple lens Q0 in the horizontal direction so that an incident angle on the first quadruple lens Q1 decreases. Accordingly, the electron beam 100 passes through the second quadruple lens Q2, closer to the central portion thereof. When the electron beam 100 passes through the main lens ML, the diameter of the electron beam 100 in the horizontal direction decreases so that the horizontal beam which is horizontally elongated as the electron beam 100 is divergent in the horizontal direction by the deflection yoke DY can be corrected. Thus, the diameter of the electron beam 100 in the horizontal direction landing on the periphery of a fluorescent screen (not shown) can be further decreased.

When the dynamic voltage is applied to the electrodes forming the quadruple lens, a halo having a star-tail shape is generated to an electron beam in the horizontal direction so that a horizontal resolution is deteriorated at the periphery of a screen.

Thus, in the present invention, the diameter of the electron beam in the horizontal direction is reduced by further forming an auxiliary quadruple lens of a positive astigmatism correction in front of the first quadruple lens of a negative astigmatism correction and the second quadruple lens of a positive astigmatism correction in a direction toward the cathode. As a result, the generation of a horizontal halo at the electron beam at the periphery of a screen can be prevented. Also, the horizontal resolution at the periphery of a screen can be improved by about 20%.

As described above, according to the present invention, by adding the auxiliary quadruple lens Q0 ahead of the two quadruple lenses Q1 and Q2, the increase of the diameter of the electron beam in the horizontal direction at the periphery of a screen can be prevented. Accordingly, a horizontal resolution at the periphery of a screen can be improved.

Also, without adding a new electrode in addition to the previously used electrodes, a new quadruple lens can be easily obtained by varying the shape of the electron beam passing holes of the previously used electrodes and the voltage applied thereto.

The three cathodes 1 are arranged adjacent to each other, as shown in FIG. 2. The three cathodes 1 emit substantially parallel electron beams in a first direction toward the screen 100. The three cathodes 1 are arranged to substantially form a horizontal row of electron beams, as shown in FIG. 2. There is a center beam disposed between and a pair of side beams. The three beams are emitted to be substantially on one horizontal plane.

Using the arrangement shown in FIGS. 2, 4, 6, and 7, the cathodes can be understood to form a horizontal row of cathodes, and the horizontal row of cathodes extends in a direction that is perpendicular to the direction of travel of the electron beams.

Using the arrangement shown in FIGS. 2, 4, 6, and 7, the cathodes can be understood to form a horizontal row of cathodes, the holes 32 are referred to as being "vertically elongated" holes 32, and the holes 51 are referred to as being "horizontally elongated" holes 51. Of course, if the features in FIG. 2 were to be oriented to be rotated 90 degrees so that the cathodes formed a vertical row instead of a horizontal row, then the holes 32 would be referred to as horizontally elongated holes 32 and the holes 51 would be referred to as vertically elongated holes 51. The principles of the present invention remain applicable in either case, and in the cases of other orientations.

For ease of description, the arrangement of features and the terms disclosed herein shall be consistent in that the row of cathodes in FIG. 2 shall be considered to be a horizontal row, the holes 32 shall be considered to be vertically elongated, and the holes 51 shall be considered to be horizontally elongated.

As shown in FIG. 2, the electron beams are emitted from cathodes 1 toward screen 100, and the direction from the cathodes 1 to the screen 100 can be said to be a first direction. The row of cathodes 1 can be said to extend in a second direction. Thus, the cathodes in FIG. 2 include a center cathode disposed between a pair of cathodes, with all three cathodes being in a row extending in the second direction. Using this terminology, the first direction is perpendicular to the second direction. The holes 32 are vertically elongated and can be said to be elongated in a third direction. The third direction is perpendicular to the first direction and is also perpendicular to the second direction. The holes 51 are horizontally elongated and can be said to be elongated in the second direction.

The foregoing paragraphs describe the details relating to a double dynamic focus electron gun for a cathode ray tube, and more particularly, to a double dynamic focus electron gun for a cathode ray tube in which an auxiliary quadrupole lens is further formed in a direction from a first quadrupole lens to a cathode and a positive astigmatism correction is performed so that a horizontal resolution at the peripheral portion of a screen can be improved.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An electron gun for a cathode ray tube, the electron gun comprising:

a triode portion including at least one cathode adapted to emit electron beams in a first direction toward a screen of the cathode ray tube, and including a control electrode and a screen electrode adapted to control the electron beams;

a plurality of electrodes including first, second, third, fourth, and fifth focus electrodes and a final acceleration electrode sequentially arranged in the first direction from the screen electrode to the screen of the cathode ray tube and adapted to form a plurality of electron lenses;

forming at least one auxiliary quadruple lens between the second and third focus electrodes, forming at least one first quadruple lens between the third and fourth focus electrodes, forming at least one second quadruple lens between the fourth and fifth focus electrodes, and forming at least one main lens between the fifth focus electrode and the final acceleration electrode in response to a screen voltage being applied to the screen electrode and the second focus electrode, a static focus voltage being applied to the first and fourth focus electrodes, a parabola type dynamic focus voltage synchronized with a deflection signal being applied to the third and fifth focus electrodes, and an anode voltage being applied to the final acceleration electrode;

the plurality of electrodes interacting with the electron beams emitted from the at least one cathode to form a parallel row of electron beams, the parallel row of electron beams extending in a second direction perpendicular to the first direction;

the third focus electrode having an input side adapted to receive the electron beams and having an output side adapted to output the electron beams; and the input side of the third focus electrode having holes arranged therein, the holes being elongated in a third direction perpendicular to the second direction.

2. The electron gun of claim 1, further comprising an electrode member arranged at the input side of the third focus electrode and forming the holes elongated in a third direction perpendicular to the second direction.

3. The electron gun of claim 1, wherein:

the second direction comprises a horizontal direction, the row of electron beams being a horizontal row;

the at least one first quadruple lens is adapted to vertically focus and horizontally diverge the electron beams; and the at least one second quadruple lens is adapted to vertically diverge and horizontally focus the electron beams.

4. The electron gun of claim 3, wherein the at least one auxiliary quadruple lens is adapted to vertically diverge and horizontally focus the electron beams upon the electron beams being deflected toward a periphery of the screen.

5. An electron gun for a cathode ray tube, the electron gun comprising:

a triode portion including at least one cathode adapted to emit electron beams in a first direction toward a screen of the cathode ray tube, and including a control electrode and a screen electrode adapted to control the electron beams;

a plurality of electrodes including first, second, third, fourth, and fifth focus electrodes and a final acceleration electrode sequentially arranged in the first direction from the screen electrode to the screen of the cathode ray tube and adapted to form a plurality of electron lenses;

forming at least one auxiliary quadruple lens between the second and third focus electrodes, forming at least one first quadruple lens between the third and fourth focus electrodes, forming at least one second quadruple lens between the fourth and fifth focus electrodes, and forming at least one main lens between the fifth focus electrode and the final acceleration electrode in response to a screen voltage being applied to the screen electrode, a static focus voltage being applied to the first and fourth focus electrodes, a parabola type dynamic focus voltage synchronized with a deflection signal being applied to the second, third, and fifth focus electrodes, and an anode voltage being applied to the final acceleration electrode;

the plurality of electrodes interacting with the electron beams emitted from the at least one cathode to form a parallel row of electron beams, the parallel row of electron beams extending in a second direction perpendicular to the first direction;

the first focus electrode having an input side and an output side, the second focus electrode having an input side and an output side, the input side of the first focus electrode adapted to receive the electron beams, the output side of the first focus electrode adapted to output the electron beams toward the input side of second focus electrode; and the output side of the first focus electrode having first holes arranged therein, the first holes being elongated in the second direction.

6. The electron gun of claim 5, the input side of the second focus electrode has second holes arranged therein, the second holes being elongated in a third direction perpendicular to the second direction.

7. The electron gun of claim 5, wherein the input side of the second focus electrode has holes arranged therein, the holes being elongated in a third direction perpendicular to the second direction.

8. The electron gun of claim 5, further comprising:

a first electrode member arranged within the output side of the first focus electrode and forming the holes elongated in the second direction; and a second electrode member arranged within the input side of the second focus electrode and forming holes elongated in a third direction perpendicular to the second direction.

9. The electron gun of claim 5, wherein the output side of the first focus electrode has first holes arranged therein, the first holes being elongated in a third direction perpendicular to the second direction.

10. The electron gun of claim 9, wherein the input side of the second focus electrode has second holes arranged therein, the second holes having a shape selected from among a circular shape and an elongated shape, the elongated shape having a central circular portion and having slot portions extending along a line in the third direction.

11. The electron gun of claim 9, comprising:

a first electrode member arranged within the output side of the first focus electrode and forming holes elongated in a third direction perpendicular to the second direction; and a second electrode member arranged within the input side of the second focus electrode and forming holes having a shape selected from among a circular shape and an elongated shape, the elongated shape having a central circular portion and having slot portions extending along a line in the third direction.

12. The electron gun of claim 5, wherein:

the first direction comprises a horizontal direction, the row of electron beams being a horizontal row;

the at least one first quadruple lens is adapted to vertically focus and horizontally diverge the electron beams; and the at least one second quadruple lens is adapted to vertically diverge and horizontally focus the electron beams.

13. The electron gun of claim 12, wherein the at least one auxiliary quadruple lens is adapted to vertically diverge and horizontally focus the electron beams upon the electron beams being deflected toward a periphery of the screen.

* * * * *